United States Patent [19]

Sekiguchi et al.

[11] 4,309,317

[45] Jan. 5, 1982

[54] CLEAR AQUEOUS OLEFIN SULFONATE SOLUTION

[75] Inventors: Shizuo Sekiguchi, Funabashi; Tetsuo Tano; Kyozo Kitano, both of Chiba, all of Japan

[73] Assignee: Lion Corporation, Tokyo, Japan

[21] Appl. No.: 119,020

[22] Filed: Feb. 6, 1980

[30] Foreign Application Priority Data

Feb. 20, 1979 [JP] Japan ..... 54-18719

[51] Int. Cl.[3] ..... C11D 1/14

[52] U.S. Cl. ..... 252/555

[58] Field of Search ..... 252/536, 555, DIG. 14, 252/546

[56] References Cited

U.S. PATENT DOCUMENTS

| | | | |
|---|---|---|---|
| 3,640,880 | 2/1972 | Martin | 252/555 |
| 3,808,156 | 4/1974 | Gorisch et al. | 252/545 |
| 3,883,447 | 5/1975 | Tokiwa et al. | 252/546 |
| 3,957,671 | 5/1976 | Sagel et al. | 252/142 |
| 4,003,857 | 1/1977 | Gorisch et al. | 252/546 |
| 4,070,309 | 1/1978 | Jacobsen | 252/547 |

OTHER PUBLICATIONS

Bio-Terge AS-35CL-Preliminary Data Sheet, Stepan Chemical Co., Northfield, Ill., Sep. 1967, pp. 1-5.

*Primary Examiner*—P. E. Willis, Jr.
*Attorney, Agent, or Firm*—Armstrong, Nikaido, Marmelstein & Kubovcik

[57] ABSTRACT

Clear and homogeneous aqueous olefin sulfonate solutions having no turbidity and suitable for use, as an active ingredient, in synthetic detergents. These solutions contains (i) 20 through 45% by weight of olefin sulfonate, (ii) 0.1 through 5 parts by weight, based on 100 parts by weight of the olefin sulfonate, of component A selected from the group consisting of (a) aliphatic polycarboxylates having carbon atoms of 2 through 6, (b) benzoates and (c) benzene carboxylates having at least one substituent selected from hydroxyl group and sulfonic group, and (iii) 1 through 10 parts by weight, based on 100 parts by weight of the olefin sulfonate, of component B selected from the group consisting of monocarboxylate having carbon atoms of 1 through 3 and gluconates.

8 Claims, No Drawings

CLEAR AQUEOUS OLEFIN SULFONATE SOLUTION

This invention relates to clear aqueous olefin sulfonate solutions which are suitable for use, as an active ingredient, in synthetic detergents. More specifically it relates to clear and homogeneous aqueous olefin sulfonate solutions which do not generate "turbidity".

It is known that olefin sulfonates are generally produced by sulfonating olefins with, for example, gaseous sulfur trioxide diluted with an inert gas and, then, neutralizing the sulfonic acids contained in the resultant sulfonated products with an aqueous alkaline solution followed by the hydrolysis of the sultone (i.e. inner ester) contained in the neutralization products in the presence of an alkali. Thus, aqueous solutions containing 20 through 45% by weight of olefin sulfonates are generally obtained. However, there is problem in that turbidity generates in these solutions due to the presence of waterinsoluble components in the solutions although these components are present in trace amounts. The generation of the turbidity in the solutions is independent of the viscosity or concentration of the solutions and the generation of the turbidity is unavoidable in some extents so long as the water-insoluble components are present in the solutions.

Concerning the improvement in the property of the aqueous olefin sulfonate solutions, it has been proposed heretofore that the viscosity of the solutions be decreased by the use of appropriate additives or the gel formation in the solution by prevented by the use of appropriate additives. Such prior arts are disclosed, for example, in U.S. Pat. Nos. 3,415,753, 3,954,679 and 4,003,857. However, these prior arts cannot make it possible to solubilize the above-mentioned water-insoluble components in the solutions and, therefore, aqueous clear olefin sulfonate solutions having no turbidity cannot be obtained. Further, even in the case where so-called hydrotrope agents, such as lower alcohols, urea, sodium sulfonate, polyethylene glycol and the like are used, the water-insoluble components contained in the aqueous olefin sulfonate solutions cannot be solubilized.

The objects of this invention are to obviate the aforementioned problem of the conventional aqueous olefin sulfonate solutions and to provide clear and homogeneous aqueous olefin sulfonate solutions which are capable of preventing the formation of "turbidity" therein.

Other objects and advantages of this invention will be apparent from the description set forth hereinbelow.

In accordance with this invention, there is provided a clear aqueous olefin sulfonate solution containing 20 through 45% by weight of at least one olefin sulfonate comprising:

A. 0.1 through 5 parts by weight, based on 100 parts by weight of the olefin sulfonate, or component A selected from the group consisting of (a) aliphatic polycarboxylates having 2 through 6 carbon atoms, (b) benzoates and (c) benzene carboxylates having at least one substituent selected from hydroxyl group and sulfonic group, and B. 1 through 10 parts by weight, based on 100 parts by weight of the olefin sulfonate, of component B selected from the group consisting of monocarboxylate having 1 through 3 carbon atoms and gluconates.

The inventors have found that the main water-insoluble components which cause the turbidity in the aqueous olefin sulfonate solutions are ferric hydroxide [$Fe(OH)_3$], 2-hydroxy alkane sulfonates and olefin oligomers and also that the problem of the turbidity generation in the aqueous olefin sulfonate solution can be effectively solved by using a combination of the above-mentioned two types of the salts or organic acids (i.e. Component A and Component B). Such salts of said acids may include lithium, sodium, potassium and magnesium.

The aqueous olefin sulfonate solution of this invention can be prepared in any conventional manner, except that the components A and B are incorporated thereinto. For instance, single alpha-olefin or mixed alpha-olefins preferably having carbon numbers of 12 to 20 are sulfonated with, for example, 1.0 through 1.2 times in amount, based on the molar quantity of the olefins, of gaseous sulfur trioxide ($SO_3$) diluted with an inert gas (e.g. air, $N_2$) at a temperature of 40° through 80° C. The sulfonated products thus obtained are neutralized with an aqueous alkaline solution, such as alkali metal salts and alkaline earth metals followed by hydrolysis. The olefin sulfonates can be in the form of alkali metal salts or alkaline earth metal salts. The suitable concentration of the olefin sulfonates in the solution is within the range of from 20 to 45% by weight. The higher concentration of the solution is not preferable from the practical point of view due to the fact that the viscosity of the solution during hydrolysis becomes too high.

The component A used in this invention includes: aliphatic polycarboxylates such as hydroxyethylenediamine triacetates, ethylenediamine tetraacetates, citrates, malates and the like; benzoates; benzene carboxylates having at least one substituent such as salicylates, sulfosalicylates and the like. These compounds can be used alone or in any combination thereof. The component A is incorporated into the aqueous olefine sulfonate solutions of this invention within the range of 0.1 through 5 parts by weight, preferably 0.5 through 3 parts by weight, based on the weight of the olefin sulfonate.

The component B used in this invention includes: monocarboxylates having carbon atoms of 1 through 3 such as formates, acetates, propionates and the like; and gluconates. These compounds can be used alone or in any combination thereof. The component B is incorporated into the aqueous olefin sulfonate solutions of this invention within the range of 1 through 10 parts by weight, preferably 1 through 5 parts by weight, based on the weight of the olefine sulfonate.

When either amount of the component A or B is less than the lower amount of the above-mentioned range, the water-insoluble components in the solution cannot be solubilized to a preferable extent. Contrary to this, when either amount of the component A or B is more than the upper amount of the above-mentioned range, the separation of the active ingredient phase and the water phase is undesirably caused due to the salting-out effect.

As mentioned hereinabove, the inventors have found that the generation of the turbidity in the aqueous olefin sulfonate solution is caused by the presense of the water-insoluble components, ferric hydroxide, 2-hydroxy alkane sulfonates and olefine oligomers in the solution. However, when the component A is used alone in the solution, although the ferric hydroxide is effectively solubilized, the other two components are not solubilized. Likewise, although the component B is effective to solubilize 2-hydroxy alkane sulfonates in the solution, the component B is not effective against the ferric hydroxide and olefin oligomers. However, surprisingly, when the components A and B are used, in combination, in the solution, as shown in the Examples hereinbelow, the three water-insoluble components can be solubilized in the solution to form a clear and homogeneous aqueous olefin sulfonate solution. Although the detailed reason of this phenomenon cannot be clearly understood at present, it is believed that, since the ferric hydroxide and 2-hydroxy alkane sulfonate are solubilized by the components A and B, respectively, to cause the disappearance of the water-insoluble substances which act as nuclei for the formation of the turbidity derived from the olefin oligomer component, the olefin oligomers are solubilized into the micelle of the olefin sulfonate.

When the aqueous olefin sulfonate solution of this invention is prepared, the components A and B can be independently added to the sulfonated olefin after neutralization and hydrolysis or prior to neutralization and hydrolysis. However, when the components A and B are added to the sulfonated olefin after neutralization, but before hydrolysis, the prevention of the turbidity formation in the solution cannot be effected so much. The components A and B can be added to the solution in the form of their precursors, that is the corresponding acids. However, it should be noted that, when the corresponding acids are added, as the precursors of the components A and B, to the solution, it is necessary to adjust the amount of the alkali added during neutralization and hydrolysis so that the acids can be converted into the salts thereof.

The aqueous olefin sulfonate solutions of this invention are preferably prepared so as to have a pH of approximately 4 through 12, more preferably approximately 5 through 12. When the pH of the aqueous olefin sulfonate solutions is less than approximately 4, foreign odors tend to be generated in the solution with the lapse of time or when heated. Contrary to this, when the pH of the aqueous olefin sulfonate solutions is more than approximately 12, the pH should be decreased when, for example, the aqueous olefin sulfonate solutions are incorporated into synthetic detergents. Since a decrease in the pH is usually carried out by the addition of a mineral acid, such as sulfuric acid, an increase in the content of inorganic salts in the detergents is inevitaby caused.

This invention now will be further illustrated by, but is by no means limited to, the following Examples.

EXAMPLE 1

Mixed alpha-olefins of $C_{14}$ and $C_{16}$($C_{14}/C_{16}=60/40$, an average molecular weight of 205) were sulfonated with a diluted gaseous $SO_3$ ($SO_3$ content=1.5% by volume) in a laboratory scale film type reactor made of glass under the conditions of a reaction temperature of 50° C. and a mole ratio of $SO_3$ to the olefins of 1.05. 100 g of the sulfonated products thus obtained were neutralized with 191 g of a 7.9% by weight aqueous sodium hydroxide solution at a temperature of 50° C. The resultant neutralized crude products were then charged into a one liter autoclave and hydrolyzed, while stirring, for 20 minutes at a temperature of 160° C. Thus approximately 290 g of an aqueous olefin sulfonate solution was obtained. The content of the active gredient in this solution (this is called "A.I. Content" hereinbelow) was 37.1%. This solution is called aqueous olefin sulfonate solution (I). The A.I. Content was determined according to a back titration method wherein methylene blue was used as an indicator.

100 g of the aqueous olefin sulfonate solution (I) obtained above was weighed into a 125 ml wide-mouthed bottle made of glass. To this solution 0.19 g (0.5% by weight, based on the weight of A.I.) of disodium ethylenediaminetetraacetate dissolved in water was added and, then, 0.74 g (2% by weight, based on the weight of A.I.) of sodium formate was added. The mixture was completely stirred. After completely dissolving the added materials in the solution, the turbidity of the solution thus obtained was determined by using an absorption photometer (made by HITACHI SEISAKUSHO, JAPAN) under the conditions of a wavelength of 600 microns and a slit width of 0.05 mm. The turbidity which was calculated as $-\log T\times 10^3$ was 4. This solution was completely clear also to the naked eye.

Comparative Example 1

The turbidity of the aqueous olefin sulfonate solution (I) obtained in Example 1 was determined in a manner as described in Example 1. The result was 63. It was also observed with the naked eye that turbidity was generated in this solution (I).

Comparative Example 2

0.19 g (0.5% by weight based on the weight of A.I.) of disodium ethylenediaminetetraacetate was added to 100 g of the aqueous olefin sulfonate solution (I) prepared in Example 1. The turbidity of the resultant solution was determined in a manner as described in Example 1. The result was 85. It was also observed with the naked eye that turbidity was generated in this solution.

Comparative Example 3

0.74 g (2% by weight based on the weight of A.I.) of sodium formate was added to 100 g of the aqueous olefin sulfonate solution (I) obtained in Example 1. The turbidity of this solution was determined in a manner as described in Example 1. The result was 83. It was also observed with the naked eye that turbidity was generated in this solution.

EXAMPLE 2

205 g (1 mol) of the mixed alpha-olefins used in Example 1 were charged in a one liter vessel type reactor made of glass (provided with a $SO_3$ feed nozzle and an agitator) and heated to a temperature of 45° C. while stirring. 85.6 g (1.07 mol) of $SO_3$ diluted with nitrogen gas to a 5% by volume concentration was introduced to the reactor over a period of one hour. After the completion of the $SO_3$ introduction, the reaction mixture was withdrawn from the reactor. 100 g of the reaction mixture thus obtained was stirred for 15 minutes and, then, neutralized with 191 g of an aqueous 7.9% by weight NaOH solution. The neutralized products were then hydrolyzed in a one liter autoclave at a temperature of 160° C. for 20 minutes. Thus, an aqueous olefin sulfonate solution (II) having an A.I. content of 37.0% by weight was obtained.

100 g of the aqueous olefin sulfonate solution (II) obtained above was weighed into a 125 ml wide-mouthed bottle made of glass and disodium ethylene diaminetetraacetate and sodium formate were added thereto in a manner as described in Example 1. After stirring well, the turbidity was determined in a manner as described in Example 1. The result was 4. The solution was completely clear to the naked eye.

Comparative Example 4

The turbidity of the aqueous olefin sulfonate solution (II) obtained in Example 2 was determined in a manner as described in Example 1. The result was 80. It was also observed with the naked eye that this solution was turbid.

EXAMPLE 3

Alpha-olefin of $C_{14}$ was sulfonated in a manner as described in Example 1 to produce the sulfonated product (I). To 87.8 g of this sulfonated product (I), 0.19 g of disodium ethylenediaminetetraacetate dissolved in water was added and, then, 0.74 g of sodium formate was added. After completely stirring, the resultant mixture was neutralized with an aqueous 7.9% by weight NaOH solution at a temperature of 50° C. The neutralized crude product thus obtained was hydrolyzed in a manner as described in Example 1. The turbidity of the resultant solution, which was determined in a manner as described in Example 1, was 4. It was also observed with the naked eye that the resultant solution was completely clear. The A.I. content of this solution was 37.1% by weight.

Comparative Example 5

0.74 g (2% by weight based on the weight of A.I.) of sodium formate was added to 87.8 g of the sulfonated product (I) obtained in Example 3. The mixture was then subjected to neutralization and hydrolysis in a manner as described in Example 3. Thus, an aqueous olefin sulfonate solution was obtained. The turbidity of this solution, which was determined in a manner as described in Example 1, was 53. It was also observed with the naked eye that turbidity was generated in this solution.

Comparative Example 6

The sulfonated product (I) obtained in Example 3 was neutralized with an aqueous NaOH solution. Formic acid was added to the neutralized crude product in an amount of 2% by weight based on the weight of the A.I. contained in the neutralized crude product and then, the mixture was hydrolyzed in a manner as described in Example 3.

The turbidity of the solution thus obtained, which was determined in a manner as described in Example 1, was 78. It was also observed with the naked eye that there was turbidity in the solution.

Comparative Example 7

To the sulfonated product (I) obtained in Example 3, 0.19 g of disodium ethylenediaminetetraacetate dissolved in water was added and stirred. The mixture thus obtained was hydrolyzed to form an aqueous olefin sulfonate solution in a manner as described in Example 3.

The turbidity of this solution, which was determined in a manner as described in Example 1, was 90. It was also observed with the naked eye that there was turbidity in the solution.

EXAMPLE 4

The sulfonated product (I) obtained in Example 3 was neutralized and hydrolyzed in a manner as described in Example 1. Thus, an aqueous olefin sulfonate solution having an A.I. content of 37.1% by weight was obtained. To this solution, 0.19 g (5% by weight based on the weight of A.I.) of disodium ethylenediaminetetraacetate dissolved in water was added and, subsequently, 0.74 g (2% by weight based on the weight of A.I.) of sodium formate was added. After completely mixing, the turbidity of the solution thus obtained was determined in a manner as described in Example 1. The result was 5. This solution was clear when it was observed with the naked eye.

Comparative Example 8

To the aqueous olefin sulfonate solution obtained in Example 4, sodium formate was added in an amount of 2% by weight based on the weight of A.I. contained in the solution.

The turbidity of the resultant solution, which was determined, after completely stirring, in a manner as described in Example 1, was 62. It was also observed with the naked eye that there was turbidity in the solution.

EXAMPLES 5 THROUGH 10

Various additives listed in the Table below were added to the sulfonated products (I) obtained in Example 3. Aqueous olefin sulfonate solutions were prepared from these mixtures in a manner as described in Example 3. The turbidity in these solutions was observed with the naked eye and also determined in a manner as described in Example 1. The results are shown in the following Table.

TABLE

| | Example No. | | | | | |
|---|---|---|---|---|---|---|
| | 5 | 6 | 7 | 8 | 9 | 10 |
| A.I. (%) | 37.0 | 37.0 | 37.0 | 37.0 | 37.0 | 37.0 |
| Component A | Citric Acid | Malic Acid | Benzoic Acid | Sulfosalicylic Acid | Hydroxyethylene diamine triacetic Acid | Citric Acid |
| (% based on A.I.) | (0.5) | (0.5) | (0.5) | (0.5) | (0.5) | (0.5) |
| Component B | Formic Acid | Formic Acid | Formic Acid | Formic Acid | Formic Acid | Gluconic Acid |
| (% based on A.I.) | (2) | (2) | (2) | (2) | (2) | (1.5) |
| Turbidity | 3 | 5 | 7 | 12 | 5 | 7 |
| Appearance | Clear | Clear | Clear | Clear | Clear | Clear |

EXAMPLE 11

To the aqueous olefin sulfonate solution obtained in Example 4, 1.5% by weight, based on the weight of A.I. contained in the solution, of gluconic acid and 0.5% by weight, based on the weight of A.I. contained in the solution, of citric acid were added and the mixture was stirred well. The turbidity of the resultant solution, which was determined in a manner as described in Example 1, was 6. The solution was clear when it was observed with the naked eye.

What we claim is:

1. A clear aqueous olefin sulfonate solution comprising 20 through 45% by weight of at least one α-olefin sulfonate having 12 through 20 carbon atoms;

0.1 through 5 parts by weight, based on 100 parts by weight of the α-olefin sulfonate, of a component A selected from the group consisting of hydroxyethylenediamine triacetates, ethylenediamine tetraacetates, citrates, malates, benzoates, salicylates and sulfosalicylates; and 1 through 10 parts by weight, based on 100 parts by weight of the α-olefin sulfonate, of a component B selected from the group consisting of monocarboxylates having 1 through 3 carbon atoms and gluconates;

said α-olefin sulfonate, and components A and B each being present in the form of a salt of lithium, sodium, potassium or magnesium or of any mixture thereof.

2. A clear aqueous olefin sulfonate solution as claimed in claim 1, wherein the component B is a formate or a gluconate.

3. A clear aqueous olefin sulfonate solution as claimed in claim 1, wherein the component A is selected from the group consisting of hydroxyethylenediamine triacetates, ethylenediaminetetraacetates, citrates, malates, benzoates and sulfosalicylates, and the components B is a formate.

4. A clear aqueous olefin sulfonate solution as claimed in claim 1, wherein the component A is a citrate and the component B is a gluconate.

5. A clear aqueous olefin sulfonate solution as claimed in any of claims 1, 3 or 4; wherein the pH of the solution is about 4 through 12.

6. A clear aqueous olefin sulfonate solution as claimed in claim 1, wherein said solution is prepared by sulfonating said α-olefin and adding said component A or its acid precursor and said component B or its acid precursor to the resulting sulfonated olefin, followed by neutralization and hydrolysis.

7. A clear aqueous olefin sulfonate solution as claimed in claim 1, wherein said solution is prepared by adding said component A or its acid precursor and said component B or its acid precursor to an aqueous solution of said α-olefin sulfonate.

8. A clear aqueous olefin sulfonate solution as claimed in claim 1, wherein the α-olefin sulfonate, and the components A and B are present in the form of salts of lithium, sodium or magnesium.

* * * * *